US009776697B2

(12) United States Patent
Zapata

(10) Patent No.: US 9,776,697 B2
(45) Date of Patent: Oct. 3, 2017

(54) FLUID OUTLET INTERFACE FOR PERSONAL WATERCRAFT, ASSOCIATED PERSONAL WATERCRAFT AND PROPULSION SYSTEM

(71) Applicant: ZAPATA HOLDING, Le Rove (FR)

(72) Inventor: Frankie Zapata, Le Rove (FR)

( * ) Notice: Subject to any disclaimer, the term of this patent is extended or adjusted under 35 U.S.C. 154(b) by 0 days.

(21) Appl. No.: 14/534,753

(22) Filed: Nov. 6, 2014

(65) Prior Publication Data

US 2015/0158567 A1 Jun. 11, 2015

Related U.S. Application Data

(60) Provisional application No. 61/901,690, filed on Nov. 8, 2013.

(51) Int. Cl.

| | |
|---|---|
| ***B63H 11/107*** | (2006.01) |
| ***B63H 1/30*** | (2006.01) |
| ***B63B 35/73*** | (2006.01) |
| ***B63H 11/04*** | (2006.01) |
| ***B63H 5/00*** | (2006.01) |
| ***B63H 11/02*** | (2006.01) |
| *B63B 35/00* | (2006.01) |
| *B63H 11/00* | (2006.01) |

(52) U.S. Cl.

CPC ..... *B63H 1/30* (2013.01); *B63B 35/73* (2013.01); *B63H 5/00* (2013.01); *B63H 11/02* (2013.01); *B63H 11/04* (2013.01); *B63H 11/107* (2013.01); *B63B 2035/004* (2013.01); *B63H 2011/006* (2013.01)

(58) Field of Classification Search

CPC ..... B63H 11/04; B63B 13/00

See application file for complete search history.

(56) References Cited

U.S. PATENT DOCUMENTS

| | | | | |
|---|---|---|---|---|
| 4,787,328 | A * | 11/1988 | Inoue | B63B 35/731 114/183 R |
| 4,850,908 | A * | 7/1989 | Nakase | B63B 35/731 114/183 R |
| 5,490,804 | A * | 2/1996 | Blanchard | B63B 59/00 440/113 |
| 6,036,556 | A * | 3/2000 | Baker | B63H 11/08 440/38 |
| 7,354,322 | B1 * | 4/2008 | Carver | B63H 11/10 440/38 |

* cited by examiner

*Primary Examiner* — Edwin Swinehart

(74) *Attorney, Agent, or Firm* — Nicholas R. Lewis, Esq.

(57) ABSTRACT

The invention relates to a fluid outlet interface for a personal watercraft, so that the latter can collect and divert a very small portion of the fluid pressurized by said vehicle and thus create a sufficient Venturi effect to drive the emptying of the bilge of said vehicle. The invention also relates to a personal watercraft, or more generally any floating device delivering a pressurized fluid, comprising such an interface.

12 Claims, 4 Drawing Sheets

FLUID OUTLET INTERFACE FOR PERSONAL WATERCRAFT, ASSOCIATED PERSONAL WATERCRAFT AND PROPULSION SYSTEM

FIELD OF THE INVENTION

The present invention relates to a fluid outlet interface for a Personal Watercraft, hereinafter referred to as PWC. Such an interface makes it possible to adapt a PWC so that it operates as a fluid compression station in addition to its primary transportation function. Such a PWC can compress and thus deliver said fluid to a third-party device. Preferably and non-limitingly, such a PWC can supply power to a propulsion device for a passenger so that the latter can travel in the air or within a fluid.

BACKGROUND OF THE INVENTION

FIG. 1 shows an example embodiment of a propulsion device 10 designed by the builder ZAPATA RACING. This device includes a main body in the form of a substantially planar platform 11 on which a passenger 1 can be positioned. The propulsion device described relative to FIG. 1 includes a thrust system cooperating with the platform 11. Such a thrust system includes one or more primary nozzles, the function which consists of propelling the device and its passenger. In the present document, we use the term "nozzle" to define a profiled channel element, intended to impose an increased speed on a flowing fluid. This increased speed of the fluid is primarily due to a difference in sections between the inlet and the outlet of the element, the outlet section being smaller than the inlet section. According to FIG. 1, such a thrust system consists of a pair of primary nozzles 12*a* and 12*b* fastened against the lower face of the platform 11. The respective fluid discharge directions of said nozzles are oriented along a normal to the platform 11, advantageously from close to the lower face 11*b* of the platform 11 toward a distance therefrom. The thrust system of such a propulsion device may further include two secondary and optional nozzles 13*a* and 13*b* to facilitate its maneuverability. These are free and designed optionally and respectively to be held by a passenger 1 at the forearms or hands. In order to deliver a sufficient thrust force and allow takeoff, then movement, the propulsion device 10 further includes means for collecting and distributing the pressurized fluid, for example water, to the primary and secondary nozzles. Such a fluid is preferably conveyed using a flexible supply pipe 2 from a remote compression station, not shown in FIG. 1. Such a supply pipe may be made from a material traditionally making up a fire hose or any other material having the necessary strength for the pressure exerted by the pressurized fluid. A collector 14 may thus have a base 14*c* to which an end 2*a* of a supply pipe 2 is connected, for example using a rib suitable for receiving said pipe 2. In FIG. 1, the collector 14 may have a shape close to a "Y" for collecting, from the base 14*c*, and distributing, via arms, the pressurized fluid to the primary pipes 12*a* and 12*b*, respectively. The end 2*a* of the supply pipe 2 may advantageously cooperate with the collector 14 at its base 14*c* using a pivot link to allow a free rotation r2 around an axis C substantially parallel to the pipe 2. The device can thus pivot freely around said axis C without creating loops or excessive stresses on the supply pipe 2.

In order to distribute the pressurized fluid to the secondary nozzles 13*a* and 13*b*, for example and as indicated in FIG. 1, secondary pipes 18*a* and 18*b*, in the advantageous form of flexible hoses, can be provided to deliver said pressurized fluid from the collector 14 to the secondary nozzles. In order to avoid bothering the passenger 1, said secondary nozzles can be guided along the back up to the shoulders by using maintaining means 19 such as straps, harnesses, etc. A passenger may further use means to restrain the secondary nozzles at forearm level.

The platform 11 may have means for maintaining a passenger on the upper face of said platform 11. Thus, depending on the preferred position of a passenger on the platform, said maintaining means may consist—as indicated in FIG. 1—of a pair of booties or fastening boots 16 of a type similar to what may for example be used in wakeboarding.

A propulsion device, for example the device 10 described relative to FIG. 1, may be supplied by any fluid compression station, as far as it is able to deliver a fluid whereof the pressure is sufficient to ensure operation of the propulsion device. The latter may be remote and dedicated to that use at the risk of increasing the overall cost of a propulsion system including a propulsion device, a compression station and a supply pipe cooperating with said device and station to convey the pressurized fluid.

In order to decrease such a cost, the compression station may advantageously be chosen to be an apparatus whereof the primary and original function is different from the function consisting of supplying pressurized fluid to a propulsion device. It is thus possible to take advantage of the original compression capacity with respect to a fluid of a PWC, for example the RUNABOUT MZR 2011 edition from the builder ZAPATA RACING.

One such vehicle 30, a side view of which is described relative to FIG. 2, includes a hull 31 and houses propulsion means 32 compressing a fluid by spinning a turbine, on the surface of which the PWC navigates, said fluid being ingested from an inlet 33 arranged below the hull 31. Said fluid, thus pressurized, is expelled from a fluid outlet situated at the rear of the vehicle. Such a fluid outlet generally assumes the form of a cone cooperating with a directional, not shown in FIG. 2, to modify the trajectory of the PWC. The means 32 are generally driven using a heat engine, also not shown in FIG. 2. To adapt such a PWC and divert the original function of the propulsion means 32, so that the latter deliver a pressurized fluid and for example supply a propulsion device like that described relative to FIG. 1, it is known to position and apply a flange or more generally an interface 100 to the pressurized fluid outlet of the means 32 of the PWC 30. This interface 100 may be designed so as simply to be able to adapt to the fluid outlet of any PWC or, alternatively, to be dedicated to one type of fluid outlet if it differs from one PWC to another. According to a first embodiment, such an adaptation method further consists of connecting a tip 2*b* of a supply pipe for conveying the pressurized fluid expelled from the fluid outlet of the PWC to a collector 34 cooperating with said interface 100. The distal part 2*a* of said supply pipe 2 cooperates with the means for collecting and distributing the pressurized fluid 14 to the nozzles of a propulsion device, like the device 10 described relative to FIG. 1. The PWC can thus interact with such a device as a remote fluid compression station.

In order to avoid a submersion risk of the PWC, if the latter was pulled from its bow by the propulsion device, the adaptation of a PWC advantageously consists further of inserting, between the collector 34 and the proximal part 2, a connecting elbow 36, arranged substantially in a "U" to orient the pressurized fluid to the outlet of said elbow along an axis substantially parallel to the hull 31 of the PWC toward the bow of said PWC. Use will advantageously be made of attaching means to moor said pipe 2 to a towing hook 37 situated at the bow of the PWC. This creates a guide for guiding the supply pipe from the stern to the bow of the PWC, preserving the navigability and compression capacities of said PWC. A propulsion device can thus move in the air or below the surface of the water while pulling the PWC by the front thereof.

Depending on the agitation of the expanse of water on which a propulsion system moves, such a system being made up of a propulsion device, a supply pipe and a remote fluid compression station, there is still a risk of the PWC becoming submerged. In fact, the laps or waves colliding with the hull of the PWC, or even the pressurized water potentially discharged from a propulsion device near the PWC, can flood the bilge of a traditional PWC. The latter generally includes an internal system for emptying the bilge working with a Venturi ejector emerging in a directional cone cooperating with the fluid outlet of the PWC. The replacement of said directional cone by placing the interface 100, to divert the pressurized fluid toward the pipe 2, makes said original bilge emptying system inoperative. During the movement of the PWC, when the latter is for example pulled by a propulsion device 10, as described relative to FIG. 1, the bilge of said PWC may fill with water gradually, encumbering the navigability of the PWC. The user of the PWC must therefore suspend its movement regularly to bail out the bilge of his PWC manually or use an additional device, for example a bilge pump, to empty said bilge. This problem may become tedious if a manual operation is necessary and increases the acquisition and maintenance costs of the equipment. Furthermore, adding such a bilge pump is sometimes rather difficult. It must be possible to identify an appropriate housing for said pump within the PWC. The latter must also be fastened on the hull of the PWC as well as one or more discharge or emptying pipes for discharging water from the bilge. Such fastenings do not make it possible to preserve the integrity of the hull of the PWC. They may even quite simply prove impossible in the case of rented equipment. Furthermore, it is necessary to provide an electricity supply for said bilge pump, which further complicates the use of that additional pump. One alternative may consist of having an off-board Venturi effect ejector at a third-party device supplied with pressurized fluid by the PWC, for example on a fluid outlet of the thrust system of said device. However, such a solution would require providing an emptying pipe connecting the fluid outlet of the thrust system to the bilge of the PWC. Such an arrangement would be technically restrictive, as well as globally inoperative, or even dangerous. In fact, depending on the length of said emptying pipe and/or the height difference between the ends of the emptying pipe, the pressure loss within the pipe would encumber or even cancel the suction generated by the ejector. The emptying of the bilge would thus be largely or completely ineffective, or could even transform into filling of the bilge, which could risk causing submersion of the PWC.

SUMMARY

The invention involves avoiding these drawbacks by proposing a particularly innovative arrangement of a fluid outlet interface. The many advantages provided by the invention include the fact that the interface includes means for ejecting fluid present in a bilge of a PWC, not requiring any structural modification or alteration of the PWC. Such an arrangement makes it possible to give the PWC a very high-performing bilge emptying system, by recreating a Venturi effect ejector with a sufficient flow rate to effectively and continuously empty the bilge of a PWC, when it supplies a third-party device with pressurized fluid. An interface according to the invention does not generate a noticeable loss of compression output and preserves the original sucking ports and bilge emptying pipes. It is therefore no longer necessary to modify the structure of the hull of the PWC or incorporate an additional bilge pump therein.

To that end, an interface is provided for cooperating with the fluid outlet of a personal watercraft pressurizing said fluid. Said interface includes a front face arranged to cooperate with said fluid outlet and a rear face. Said interface further includes a main opening, the axis of revolution of said main opening being normal to the front face of the interface, the proximal cross-section of said main opening having dimensions and a shape that are similar to those of the section of said fluid outlet. In order to create a Venturi effect ejector causing emptying of the bilge of said vehicle, the interface includes a recess arranged in its thickness, said recess emerging in the main opening to form a port collecting part of the pressurized fluid, when the latter passes through the main opening of the interface. Furthermore, the interface cooperates with the distal part of an emptying pipe, said distal part of the emptying pipe emerging from the rear face of the interface jointly with the recess by a through hole, the section of said through hole having dimensions larger than those of the section of the outer wall of the distal part of the emptying pipe.

According to one advantageous embodiment, the recess may include a shoulder in the form of a resultant of a first hole emerging in the main opening, the section of which is that of the collecting port, and a second, blind hole, with a section concentric to the section of the first through hole and the dimensions of which are larger than those of said section of the first through hole, the two holes being arranged from the outer wall of the interface. To avoid encumbering the collecting port, the invention provides that such an interface may include a grate affixed against the shoulder of the recess, said grate being substantially planar and having dimensions substantially the same as those of the section of the recess upstream from the shoulder.

To fasten said grate advantageously, the recess may be pierced-tapped and blind from the outer wall of the interface to cooperate with one or more tightening screws, the respective lengths of said screws being determined so that said screws, passing through an occluder plate having dimensions larger than those of the section of the recess when said recess emerges from the outer wall of the interface, and bearing against the grate, mounts the occluder plate and said grate tightly against the outer wall of the interface and the shoulder, respectively.

To maintain an optimal output of the suction of fluid blocking a bilge of the vehicle, irrespective of the navigability conditions of said vehicle, an interface according to the invention may include an additional fluid ejector cooperating with the rear face of the interface and the orifice of the through hole.

According to one advantageous embodiment, the additional ejector may include a tubular and hollow main body.

In order to fasten such an additional ejector on the interface, the proximal part of the additional ejector may advantageously be threaded to cooperate with the orifice of the through hole, the part forming the latter being tapped beforehand.

In order to improve the yield of the additional ejector, the proximal part thereof may include an insert cooperating with the main body of said additional ejector.

In order to favor the ejection of the fluid at the outlet of the interface, the inner wall of the proximal part of the insert may then advantageously describe a convergent cone arranged to surround the distal part of the emptying pipe, said cone and said distal part of the emptying pipe being mutually arranged to form an annular interstice within which the fluid, coming from the collecting port, can flow between the outer wall of the distal part of the emptying pipe and the outer wall of the proximal part of the insert.

In order for the additional ejector to be able to cause the ejected fluid to flow optimally, like a tap, it is interesting to slow the flow speed within the insert. The latter may further be arranged so that the inner wall of the distal part of said insert describes a divergent cone.

In order to create a turbulent flow of the fluid within the main body of the additional ejector, the inner wall of said main body may include ribs.

In order to fasten the insert within the main body of the additional ejector, the outer wall of said insert may include teeth arranged to cooperate with the inner ribs of said main body of the ejector.

According to a second subject-matter, to divert a personal watercraft from its original function and convert it into a fluid compression station, the invention provides for adapting a personal watercraft including a hull, propulsion means compressing, by spinning a turbine, a fluid ingested from an inlet and expelling said fluid thus pressurized from a fluid outlet at the rear of said vehicle, an emptying system for emptying a bilge including an emptying pipe, the proximal part of which emerges in said bilge, so that said vehicle includes an interface according to the invention, said interface cooperating with the distal part of said emptying pipe.

Such a personal watercraft thus adapted makes it possible to form a propulsion system, including a propulsion device having a body arranged to receive a passenger and cooperating with a thrust system supplied with pressurized fluid from said personal watercraft.

In order to convey the fluid pressurized by said vehicle, such a system may include a supply pipe cooperating on the one hand with the propulsion device and on the other hand with the rear face of the interface of the vehicle so that said vehicle delivers the pressurized fluid to the device via the supply pipe.

BRIEF DESCRIPTION OF THE DRAWINGS

Other features and advantages will appear more clearly upon reading the following description and examining the accompanying figures, in which.

DETAILED DESCRIPTION

Thus, the invention provides for adapting a fluid outlet interface of the PWC, so that the latter can collect and divert a very small portion of the fluid pressurized by the PWC and thus create a sufficient Venturi effect to drive the emptying of the bilge of said PWC. Such a solution may be used on any floating device, irrespective of whether it is able to carry a passenger, that may deliver a pressurized fluid to a third-party device. In the rest of this document, the terms "personal watercraft" or "PWC" encompass any floating device supplying pressurized fluid to a third-party device.

Figure 1:
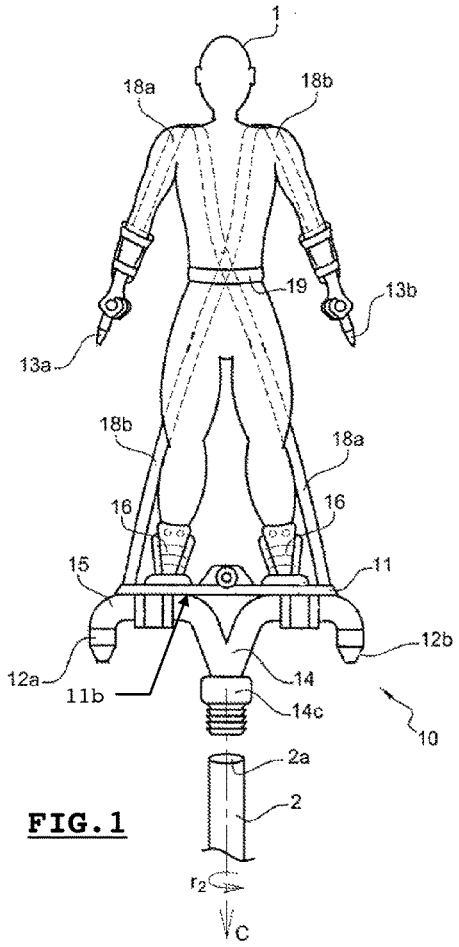
FIG. 1 shows an example of a propulsion device with a passenger, said device being supplied with pressurized fluid.
Figure 2:
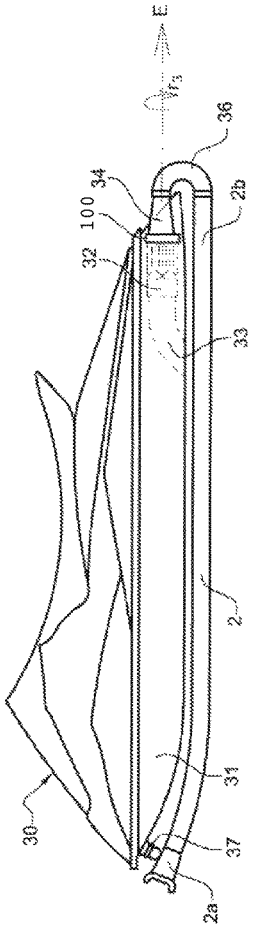
FIG. 2 describes a PWC suitable for delivering a fluid pressurized by spinning a turbine via an outlet interface by means of a supply pipe.
Figure 3:
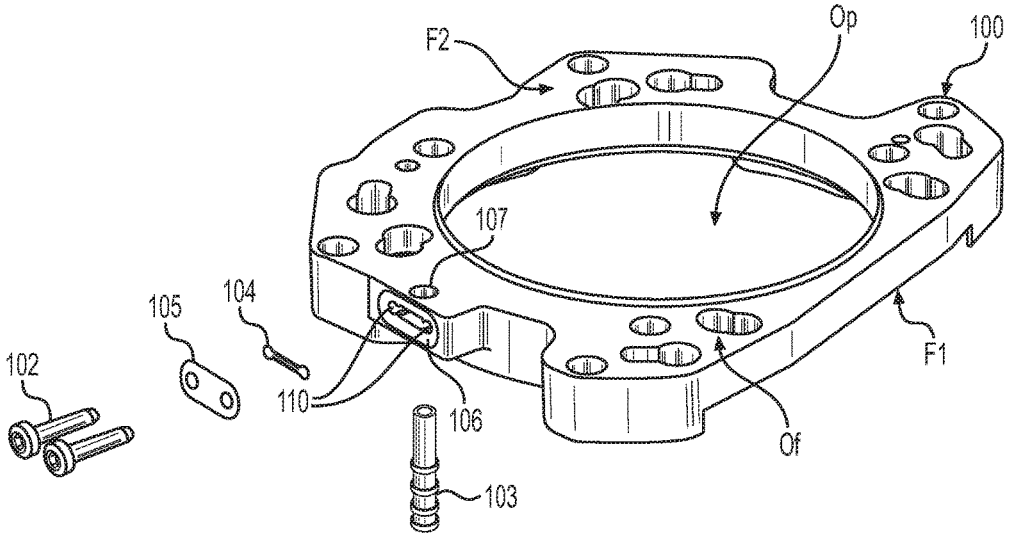
FIG. 3 describes a fluid outlet interface according to the invention.

According to FIG. 3, a first embodiment of an interface 100 according to the invention consists of a plate having a first face F1, called "front face", designed to cooperate, for example fastened using bolts, with the fluid outlet of the propulsion means 32 of the PWC, like that described relative to FIG. 2. This front face F1 is therefore arranged to be pressed against said fluid outlet. The plate of the interface 100 includes a second face F2, called "rear face", designed to cooperate, for example fastened using bolts, with the collector 34, like that described relative to FIG. 4. Said plate, said collector 34 or even elbow 36 or any intermediate additional element between said rear face F2 of the plate and a pipe for delivering the pressurized fluid, crossing through said plate, could constitute only one single entity that we will hereinafter encompass using the term "interface".

The rear face F2 could alternatively cooperate with a directional or power limiting means, in the form of a directional cone or steerable flaps. The interface 100 includes an opening Op substantially compliant with the configuration or shapes, and dimensions, of said fluid outlet of the compression means 32 of the PWC. It generally has a circular section. The main opening could, however, the arranged to include front and rear faces with different sections, both in terms of dimensions and/or shape. The interface 100 may thus have a gradual transformation function for the fluid outlet section along its thickness. As an example, the front face F1 could have a circular section and the rear face could have an oval or oblong section. Irrespective of the arrangement of the main opening Op, on the periphery thereof, the interface 100 includes one or more secondary openings, or through holes, oriented along a normal shared by the faces F1 and F2 of the interface 100. These secondary openings may preferably be oblong so as each to receive a fastening bolt, or equivalent fastening means, to affix the interface 100 against the fluid outlet of the propulsion means of the PWC.

Figure 4:
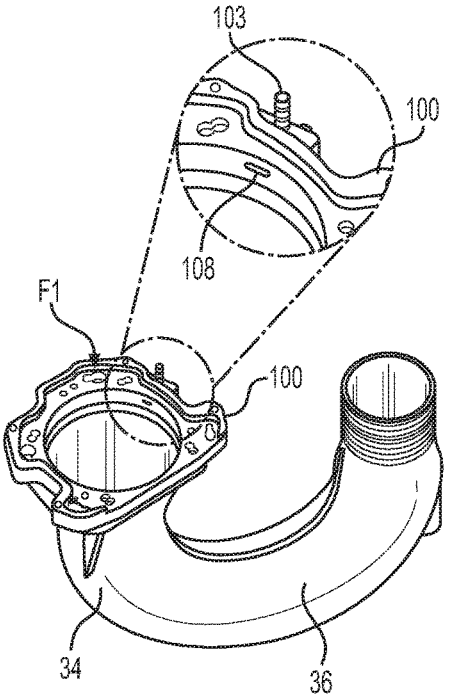
FIG. 4 describes a view of the front face of a fluid outlet interface according to the invention, said interface being connected to a connecting elbow for a supply pipe.
Figure 5:
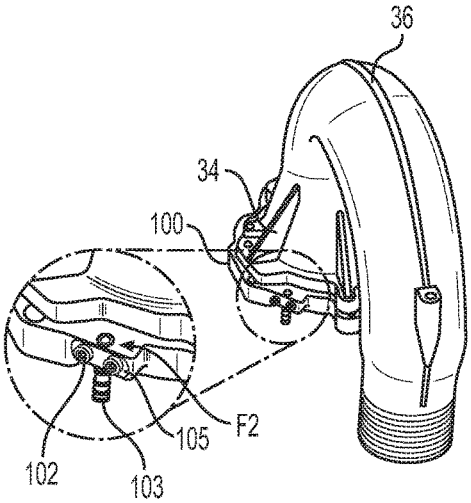
FIG. 5 describes a view of the rear face of a fluid outlet interface according to the invention, said interface being connected to a connecting elbow for a supply pipe.

In order to collect part of the fluid pressurized by the PWC and thus create a particularly clever and effective Venturi ejector, the interface 100 includes, in its thickness, a recess 106 with a substantially oval or rectangular section. This recess 106 emerges within the main opening Op to form a collecting port 108 for collecting part of the pressurized fluid passing through said main opening Op. Such a collecting port 108 is described relative to FIG. 4 showing an enlargement of the inner wall of the main opening Op of the interface 100 when the latter cooperates, as one non-limiting example, with a conical collector 34 and an elbow 36.

Figure 7:
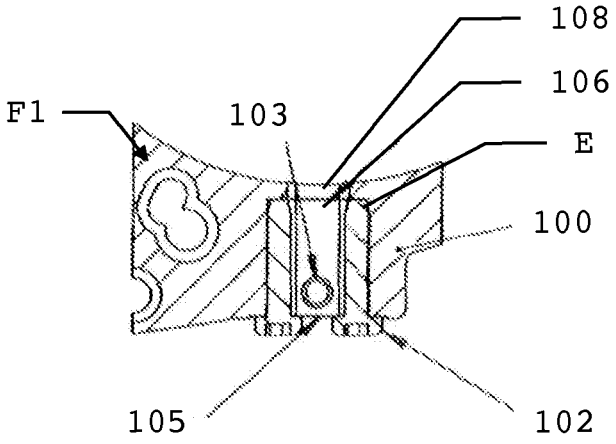
FIG. 7 describes a partial view of a longitudinal cross-section of a fluid outlet interface according to the invention.

Such a recess 106 may be defined as the resultant of a first through hole in the main opening Op, the section of which is that of the collecting port 108, and a second blind hole, with a section concentric to the section of the first through hole and the dimensions of which are larger than those of said section of the first through hole, the two holes being arranged from the outer wall of the interface 100. Such a recess 106 thus has a shoulder E as described relative to FIG. 7. The latter describes an enlargement of the longitudinal section of the interface 100, i.e., along the plane of symmetry of said recess normal to the axis of revolution of the main opening Op. The dimensions of the port 108 are thus preferably smaller than those of the section of the recess 106 on the periphery of the interface 100.

In this way, the invention provides that a grate 104, arranged to filter any bodies ingested by the propulsion means of the PWC, can advantageously be affixed against the shoulder E to preserve the flow of fluid penetrating via the collecting port 108, as indicated in FIG. 3. The grate 104, which is substantially planar, may advantageously be arranged to have dimensions substantially similar to those of a section of the recess 106 upstream from the shoulder E.

As indicated in FIG. 3, the recess 106 may be pierced-tapped and blind 110 from the outer wall of the interface 100 to receive one or more tightening screws 102. The respective lengths of said screws will advantageously be adjusted and determined so that they pass through an occluder plate 105, with dimensions larger than those of the section of the recess 106, and bear against the grate 104, tightly mount said occluder plate and the grate against the outer wall of the interface and the shoulder E, respectively. The occluder plate 105 thus makes it possible to close the recess 106 and ensure the tightness thereof on the side of the outer wall of the interface 100.

Figure 6:
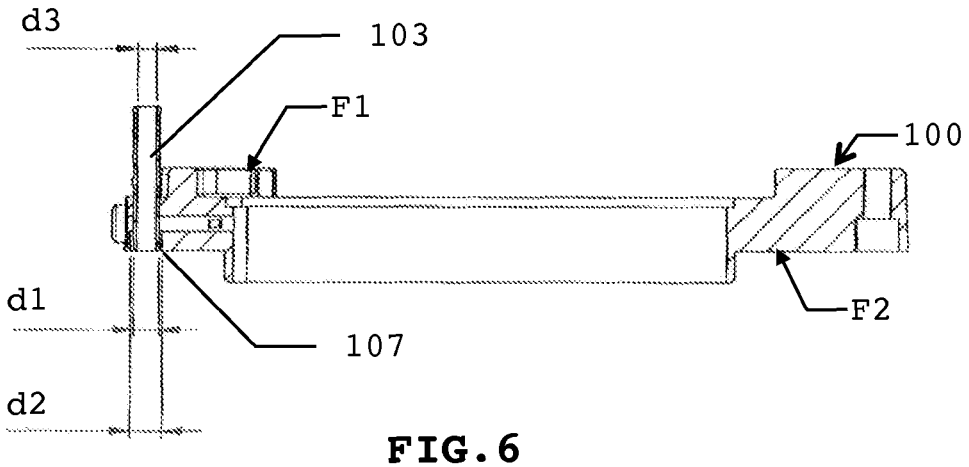
FIG. 6 describes a cross-section of a fluid outlet interface according to the invention.

As indicated by FIGS. 3 and 6, the interface 100 further includes a through hole 107 along a normal shared by the front F1 and rear F2 faces and passing through the recess 106. This hole makes it possible to establish two new recesses or bores respectively emerging on said front F1 and rear F2 faces. The recess emerging on the front face F1 is provided advantageously to include a circular section with a diameter d1 smaller than that d2 of the circular section of the second through recess of the rear face F2.

The diameter d1 is advantageously adjusted to be substantially identical to that of the distal part of the pipe 103 of the bilge emptying system of the PWC, with inner diameter d3. Said pipe 103 advantageously emerges from the hole 107 at the rear face F2. Alternatively, the element 103 consists of a substantially cylindrical adapter, the distal part of which, emerging from the front face F1, includes ribs provided to cooperate with the inner wall of said pipe of the emptying system, said pipe being comparable to a hose with a constant section.

The mutual arrangement of the recess 106 and the hole 107 thus makes it possible, after inserting the end of the pipe or adapter 103 into said hole 107 from the front face F1 of the interface 100, to create a flow of pressurized fluid, from the collecting port 108, along the recess 106, within the hole 107 emerging from the rear face F2 of the interface 100. In fact, in light of the outer diameter d1 of the emptying pipe 103 and the diameter d2 of the section of the hole 107 emerging from the rear face F2, an annular interstice 200*i*, in the vicinity of one to two millimeters thick, is arranged or left free, between the outer wall of the emptying pipe 103 and the wall of the interface forming the hole 107, to eject said flow. Such a fluid creates a sufficient vacuum to suction the content of the emptying pipe 103, the distal part of which is flush with the rear face F2 of the interface 100, and therefore the fluid obstructing the bilge of the PWC, if the proximal part of said emptying pipe 103 is positioned at the bilge bottom of said PWC. This is in particular the case if said emptying pipe 103 is a pipe of the original bilge emptying system of the PWC. A Venturi ejector is thus created at the interface 100.

The invention further provides that a plurality of recesses 106-107 can be arranged to connect a plurality of pipes 103, respectively.

This first embodiment with a Venturi ejector at the interface 100 procures a particularly high-performing emptying system. It is thus possible to observe a suction in the vicinity of one thousand liters per hour, which makes it possible to maintain an unobstructed PWC bilge.

Such an arrangement may lose some of its efficiency when the recess 107 does not constantly emerge below the float line of the PWC. In fact, such an ejector has its best output when the hole 107 emerging from the rear face F2 of the interface 100 is submerged. Based on the movements of the PWC on the surface of the water or along the waves, the hole 107 may emerge.

The invention provides an alternative embodiment of an interface including a fluid ejector to resolve this drawback and thus maintain optimal output irrespective of whether the hole 107 emerging from the rear face is submerged. According to this alternative, an additional fluid ejector is positioned on the end of the hole 107 emerging from the rear face F2 of the interface 100. Such an additional device 200 is illustrated by FIGS. 8 to 10.

Figure 8:
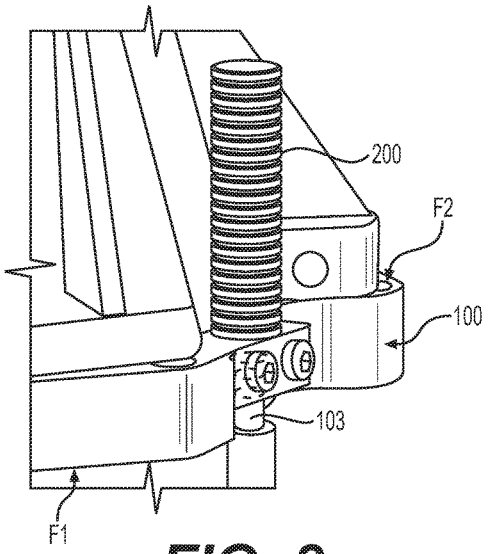
FIG. 8 shows a fluid outlet interface according to the invention including an additional fluid ejector.

Thus, FIG. 8 has a fluid outlet interface 100 according to the invention including said additional fluid ejector 200. The latter advantageously includes a tubular and hollow main body. Its length is predetermined and suitable for the desired performance. As one non-limiting example, such a length is approximately eight centimeters to procure an effective fluid ejection for emptying a bilge of a PWC. The proximal part of the additional ejector 200 cooperates with the rear face F2 of the interface 100, along a normal thereto, and with the orifice of the through hole 107. To fasten the additional ejector 200 on the interface 100, the wall forming said hole 107 is advantageously tapped. The outer proximal part of said ejector 200 is threaded to cooperate with the tapped wall forming said hole 107. Other fastening methods for fastening the additional ejector 200 on the rear face F2 of the interface 100 could be considered. The two elements could alternatively form a single and same entity.

Figure 9:
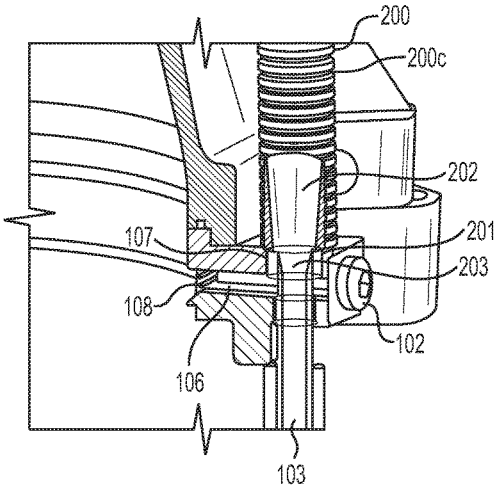
FIG. 9 shows a cross-section of a fluid outlet interface according to the invention including an additional fluid ejector.
Figure 10:
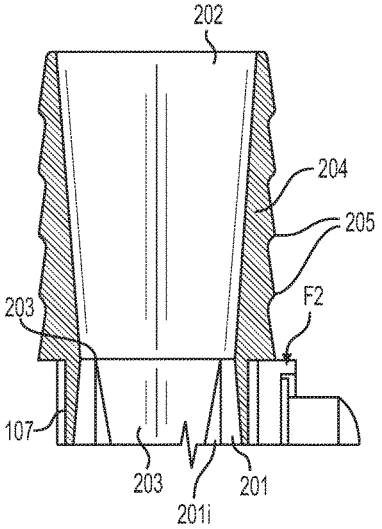
FIG. 10 describes a partial enlargement of the cross-section of an additional fluid ejector for a fluid outlet interface according to the invention.

FIG. 9 describes a cross-section of a fluid outlet interface 100 according to the invention and including an additional fluid ejector 200, in a plane comprising the axis of revolution of said additional ejector 200. According to this FIG. 9, the ejector 200 includes an insert cooperating with the proximal part of the ejector 200. The outer proximal part emerging from said insert is threaded to cooperate with a wall forming the hole 107, when the latter is tapped beforehand. The section of the inner wall of the insert may be constant. However, in order to improve the performance of the interface 100 according to the invention, the proximal part of the insert may have an inner wall describing a convergent cone 201. Furthermore, the distal part 203 of the emptying pipe or the adapter 103 is advantageously flared to describe a divergent cone. This distal part may result from the use of a coupler, for example made from a non-oxidizable material, cooperating with the element 103 and flush with the rear face F2 of the interface 100 within the recess 107. The convergent cone 201 is advantageously arranged and sized to surround the distal part 203 of the emptying pipe 103. This mutual arrangement of the elements 203 and 201 makes it possible to arrange an annular interstice 200*i* within which the fluid, coming from the collecting port 108, flows. The latter flows between the outer wall of the distal part 203 of the emptying pipe 103 and the outer wall of the proximal part 201 of the insert. The thickness of said interstice 200*i* decreases when the fluid comes closer to the rear face F2 of the interface 100, in order to accelerate said fluid and favor its ejection. The insert, within the additional ejector 200, may furthermore be arranged to describe an inner wall in the form of a divergent cone 201. Said insert thus advantageously describes two parts: a proximal part in the form of a convergent cone, and a distal part in the form of a divergent cone. However, the arrangement of the insert is such that its inner wall does not have any marked discontinuity or shoulder. The height of the divergent cone 202 is advantageously greater than that of the convergent cone 201. The latter is substantially equal to the depth described by the hole 107 when the latter passes through the rear face F2 to emerge in the pipe 106. The height of the cone 202 is determined to gradually reduce the speed of the ejected fluid. As a non-limiting example, said heights are in the vicinity of ten millimeters for the cone 201 and 30 millimeters for the cone 202, when the main body of the ejector 200 has a length of approximately twenty-four millimeters. Other dimensions may, however, be used. To avoid any pressure loss, the divergent cone 202 emerges, at its distal part, against the inner wall of the cylindrical main body of the ejector 200. In other words, the inner end section of the insert is substantially equal to that of the inner wall of said body. To offer good adhesion of the insert within the cylindrical body of the ejector 200, the diameter of the section of the outer wall of said insert is substantially identical to that of the inner wall of the main body of the ejector 200.

Surprisingly, if the inner wall of the main body of the additional ejector advantageously has ribs, i.e., has discontinuities 200*c* with repeated sections, the flow of the fluid coming from the insert is no longer laminar, but becomes turbulent. Jointly with the slowing effect of the cone 202, the asperities or ribs 200*c* cause filling of the distal part of the ejector 200, which delivers the ejected fluid, like a tap. On the one hand, the flow rate and section are maximized as a result, but above all, the inner distal part of the additional ejector 200 is kept filled with fluid, whether the latter is submerged or emerges from the water or fluid on which the PWC is traveling. Such an arrangement of the main body of the ejector may be likened to a sheath portion for electrical ducts that one wishes to embed in a partition. Thus, the main body of the additional ejector 200 may include, as indicated in FIG. 9, ribs 200*c* over its entire height, on its inner wall, or even on its outer wall. In order to increase the strength of said main body on the insert of the ejector 200, with the exception of the advantageously threaded proximal portion substantially corresponding to the inner cone 201 and cooperating with the wall forming a hole 107, the outer wall of said insert may include teeth 205 arranged to cooperate with the ribs or inner striations 200*c* of the main body of the ejector 200 as indicated in FIG. 10, the latter illustrating a partial enlargement of the cross-section of an additional fluid ejector 200 for a fluid outlet interface 100 according to the invention.

The invention claimed is:

1. An interface for cooperating with a fluid outlet of a personal watercraft pressurizing said fluid, said interface comprising:

a front face arranged to cooperate with said fluid outlet;

a rear face opposite the front face;

a main opening extending through the interface from the front face to the rear face along a first axis, the main opening having dimensions and a shape compliant with dimensions and a shape of a section of said fluid outlet;

a hole extending from the front face to the rear face substantially parallel to the main opening, wherein the hole has a varying diameter along a length thereof;

a passage extending substantially perpendicular to the main opening, wherein the passage is in fluid communication with the main opening and the hole; and a fluid ejector coupled to the hole and extending from the rear face, wherein the ejector defines a convergent cone therein and a divergent cone concentric to the convergent cone.

2. The interface according to claim 1, wherein the passage includes a shoulder proximate to the main opening.

3. The interface according to claim 2, further comprising a grate affixed against the shoulder.

4. The interface according to claim 3, wherein at least a portion of the passage is threaded to receive one or more tightening screws therein.

5. The interface according to claim 1, wherein the ejector includes a tubular and hollow main body.

6. The interface according to claim 5, wherein the ejector is threaded to engage the hole.

7. The interface according to claim 1, wherein an inner wall of the ejector includes ribs.

8. The interface according to claim 1, wherein the divergent cone defines a height greater than a height defined by the convergent cone.

9. The interface according to claim 1, wherein a height defined by the convergent cone is substantially equal to a depth defined by the hole.

10. A personal watercraft, comprising:

a hull;

a fluid inlet;

a pressurized fluid outlet;

a bilge emptying system including an emptying pipe; and an interface including:

a front face, a rear face opposite the front face, a main opening extending through the interface from the front face to the rear face coaxial with the pressurized fluid outlet, a hole extending from the front face to the rear face substantially parallel to the main opening and in fluid communication with the emptying pipe, and a passage extending substantially perpendicular to the main opening, wherein the passage is in fluid communication with the main opening and the hole.

11. The personal watercraft according to claim 10, further comprising a propulsion device in fluid communication with the pressurized fluid outlet, the propulsion device having a body arranged to receive a passenger.

12. The personal watercraft according to claim 11, further including a supply pipe coupled to the rear face of the interface and configured to deliver pressurized fluid to the propulsion device.

* * * * *